US005181347A

United States Patent [19]

Green

[11] Patent Number: 5,181,347

[45] Date of Patent: Jan. 26, 1993

[54] DRUM SANDER AND FASTENERS

[76] Inventor: Gary L. Green, 17065 Judicial Rd., Lakeville, Minn. 55044

[21] Appl. No.: 732,466

[22] Filed: Jul. 18, 1991

[51] Int. Cl.[5] ..... B24B 45/00

[52] U.S. Cl. ..... 51/370; 51/367; 51/382

[58] Field of Search ..... 51/370, 364, 367, 368, 51/384, 382, 386, 387

[56] References Cited

U.S. PATENT DOCUMENTS 2,278,564 4/1942 Reid ..... 51/367

4,720,940 1/1988 Green ..... 51/166 R

*Primary Examiner*—Bruce M. Kisliuk

*Assistant Examiner*—Eileen P. Morgan

*Attorney, Agent, or Firm*—Palmatier, Sjoquist & Helget

[57] ABSTRACT

A fastening device for continually taking up slack in a strip of abrasive paper wound helically about a rotatable drum sander. Rotation of the drum sander tends to cause the helical abrasive strip to tighten its wrap about the drum and to cause a linear extension or slack in the strip. The fastening device is spring biased to continually tighten the strip to take up any slack that may develop.

10 Claims, 2 Drawing Sheets

DRUM SANDER AND FASTENERS

BACKGROUND OF THE INVENTION

This invention relates to a rotary drum sander of the type typically used in woodworking operations, and more particularly to drum and attachment clips for conveniently attaching a helical wrap of sandpaper to the drum.

Rotary drum sanders are typically used in woodworking projects, wherein the drum is rotatably mounted on a vertically-adjustable assembly, positioned over a horizontal bed. A workpiece is moved across the horizontal bed through the adjustable gap between the drum and the bed, so that the surface of the workpiece may be contacted by the drum as it passes through the gap. The gap is typically adjusted to be slightly narrower than the thickness of the workpiece, to permit the sanding material on the surface of the drum to abrade the workpiece.

The sanding drum is typically about 5 inches in diameter and has a length of typically 25 inches. One form of product for which the invention is particularly adapted is a product manufactured by Performax Products, Inc., Burnsville, Minn., under the product designation Super-Max Drum Sander. This form of drum sander utilizes a sandpaper strip of 3 inches in width, wherein the strip is helically wound about the drum and is attached at each of its ends to the drum. The present invention provides an improved drum and attachment mechanism for enabling the convenient installation of the sandpaper strip about the surface of the drum.

SUMMARY OF THE INVENTION

The principal object of the present invention is to provide a drum and attachment mechanism for convenient attachment of a sanding strip to the drum surface.

Another object of the invention is to provide a sanding strip attachment mechanism which permits easy and convenient disassembly of a sandpaper strip and replacement thereof.

Another object of the invention is to provide sanding strip attachment fastener clips which take up slack resulting from stretching of the sanding strip on the surface of the drum over a period of use.

The invention comprises a sanding drum having an edge slot cut into each of its ends, and a pair of spring-biased clip fasteners, each fastener affixed along an inside drum surface adjacent a respective slot. At least one of the fasteners is arranged with a spring-loaded lever arm to bias inwardly the end of the sandpaper strip to which it is connected.

The foregoing and other objects, advantages and features will become apparent from the following specification and claims, and with reference to the appended drawings.

DETAILED DESCRIPTION OF THE PREFERRED EMBODIMENTS

Figure 1:
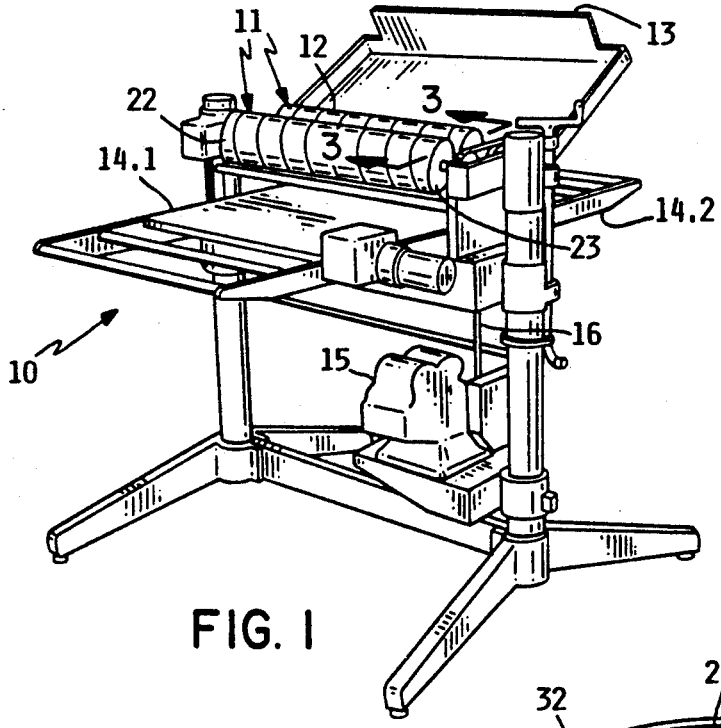
FIG. 1 is a perspective view of a rotary drum sander with a rotatable sanding drum.

As shown in FIG. 1, a dual rotary drum sander is indicated in general by the reference numeral 10. It includes of pair of primary and secondary rotatable sanding drums 11 upon which strips 12 of abrasive paper are wound in a helical or spiral manner. The rotary drum sander 10 further includes a safety cover 13 for the drums 11, an inlet feed table portion 14.1 on which a workpiece is fed for engagement with the drums 11, an outlet feed table portion 14.2 for receiving a sanded workpiece, and an electric motor unit 15 with a belt 16 for driving the drums 11. The rotary drum sander 10 is typically used for abrasive planing, surfacing boards, stock removal, glue removal, dimensioning boards, trueing warped boards, removing planar ripples, and finish sanding.

Figure 2:
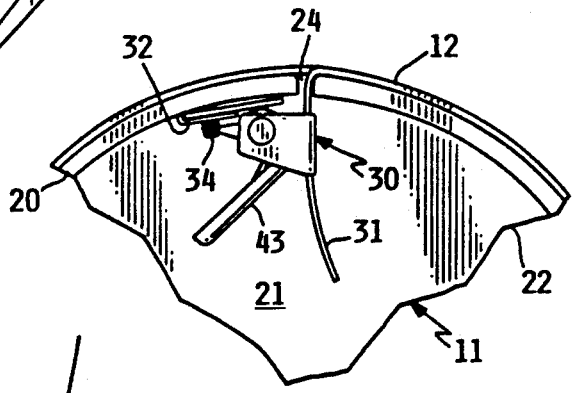
FIG. 2 is a detailed elevation view of one of the ends of the rotatable drum of FIG. 1, and one of the fasteners for holding the strip of abrasive paper on the drum.
Figure 4:
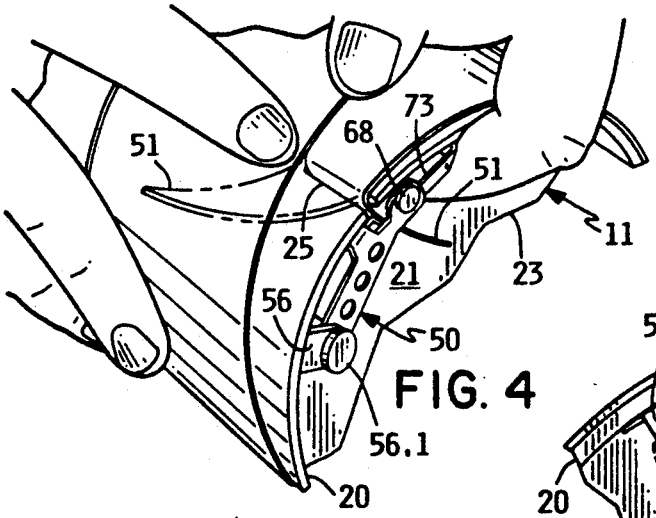
FIG. 4 is a detailed perspective view of the other end of the rotatable drum of FIG. 1 with the other fastener for the other end of the strip of abrasive paper.

As shown in FIGS. 2 and 4, each of the drums 11 includes an outer cylindrical wall 20 about which the abrasive strip 12 is wrapped, and a number of radially extending disk-like wall supports 21 disposed in the drum 11. Each of the opposing ends 22, 23 of the drums 11 as shown in FIGS. 2 and 4, respectively, includes respective edge slots 24, 25 for receiving tapered end portions of the abrasive strip 12. The present invention is typically utilized on both the primary and secondary drums 11, but for purposes of clarity the present invention is described hereinafter as relating to one drum 11.

Figure 3:
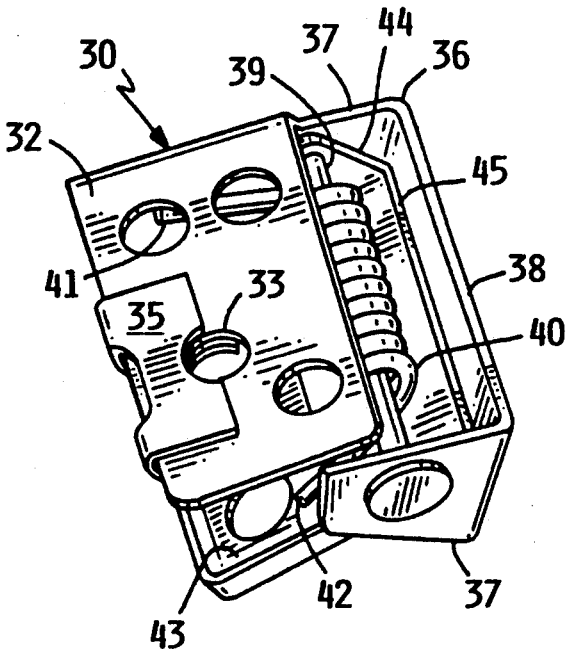
FIG. 3 is a detailed perspective view of the fastener of FIG. 2.

As shown in FIGS. 2 and 3, a fastening means or fastener clip 30 is secured to the undersurface of the cylindrical wall 20, adjacent the first end 22 of the drum 11, and adjacent to the edge slot 24, for securing a first, tapered, strip end portion 31 of the abrasive strip 12. The clip 30 includes a base 32 with an aperture 33 for receiving a screw 34. The screw 34 passes through aperture 33 and passes through an aperture formed in the cylindrical wall 20, and engages a lock 35. The head of the screw rests in an inset formed in the outer surface of the cylindrical wall 20 to provide a smooth surface for engaging the abrasive strip 12.

The base 32 of fastener 30 is integral with a U-shaped framing member 36 which includes end portions 37 and a plate portion 38. The end portions 37 mount a rod or rivet 39, which in turn mounts a torsion spring 40 having two ends 41, 42. One end 41 engages the base 32; the other end 42 engages a plate member or lever arm 43 having apertured tabs 44 for pivotal engagement with the rod 39. The plate member 43 includes a continuous edge 45 for engaging the end portion 31 of abrasive strip 12, which is fed and pinched between the edge 45 and the inner side of plate member 38. To insert the strip end portion into the clip 30, the lever arm 43 is drawn toward the base 32. After the strip end portion has been inserted, the arm 43 is released to bring the edge 45 to bear against the strip end portion 31 to pinch the strip end portion 31 against plate member 38. The angular position of lever arm 43 relative to framing member 36 is chosen so that edge 45 will securely clamp against the abrasive strip 12. This clamping angle is such that, as the linear force along abrasive strip 12 is increased, the clamping force provided by edge 45 also increases. Therefore, the clamping angle assists the torsion spring 40 in grasping the abrasive strip 12.

It should be noted that the base 32 and lever arm 43 include a number of holes to reduce weight, as a lower weight fastener clip aids in balancing the drum 11. A counterweight is typically affixed to the inner surface of the cylindrical wall 20 diametrically opposite of the clip 30 to balance the drum 11.

Figure 5:
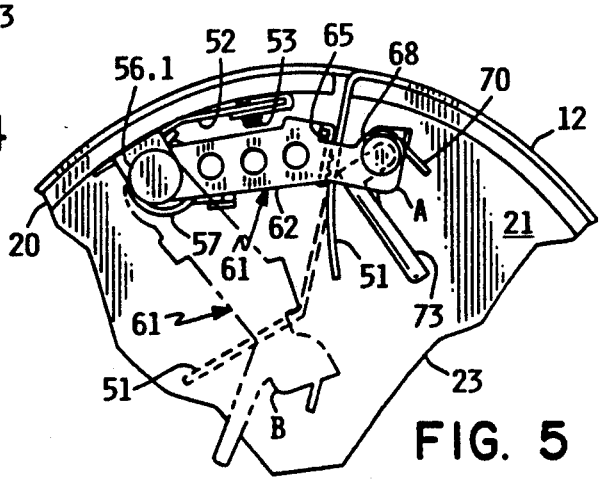
FIG. 5 is a detailed elevation view of the end of the rotatable drum and fastener shown in FIG. 4, and shows the lever arm of such fastener in an initial position and a subsequent position, the latter of which shows the lever arm in phantom after the lever arm has taken up slack in the strip of abrasive paper.
Figure 6:
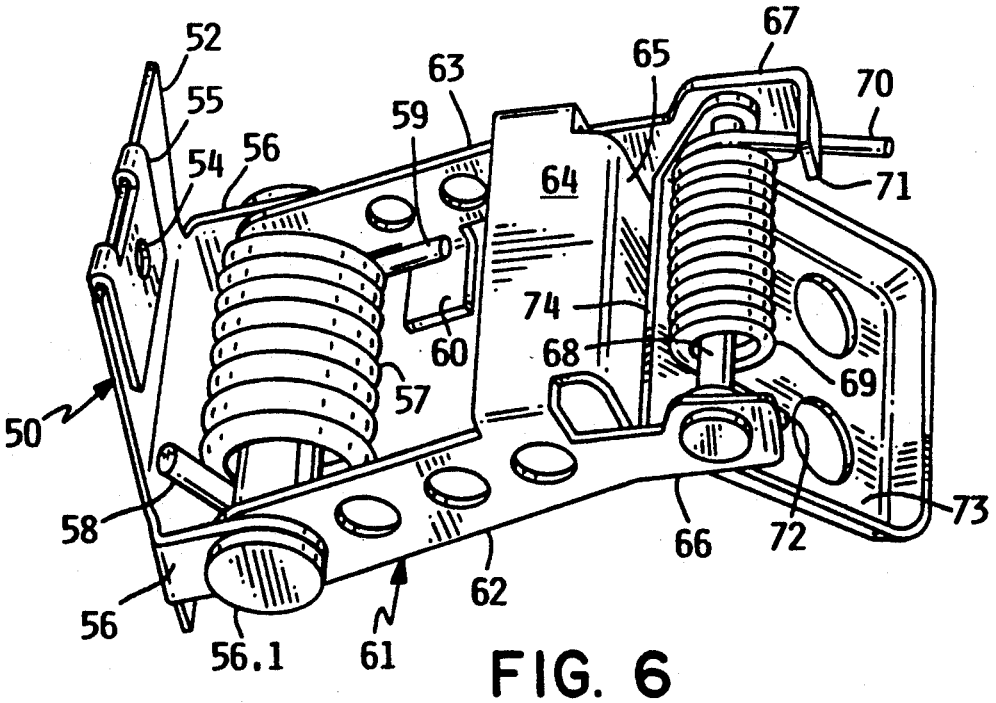
FIG. 6 is a detailed perspective view of the fastener of FIGS. 4 and 5.

As shown in FIGS. 4, 5 and 6, a connecting means or fastener 50 is secured to the undersurface of the cylindrical wall 20, adjacent the second end 23 of the drum 11, and adjacent to edge slot 25, for securing a second strip end portion 51 of the abrasive strip 12. The connecting means 50 includes a base plate 52 which is secured to the inner side of the outer cylindrical wall 20 of the drum 11 via a screw 53. The screw 53 engages an aperture 54 of a lock 55 and passes through a hole in the cylindrical wall 20. The head of the screw 53 rests in an inset formed in the outer surface of the cylindrical wall to provide a smooth surface for engaging the abrasive strip 12. The base plate 52 includes integral tabs 56 for mounting a rod 56.1 which in turn mounts a main torsion spring 57 with two ends 58, 59. One end 58 brings pressure to bear on base plate 52; the other end 59 brings pressure to bear on a tab 60 which is integral with a take-up lever arm 61.

The take-up lever arm 61 includes opposing side frame members 62, 63 which are pivotally mounted at their proximal ends to rod 56.1. The side frame members 62, 63 are rigidly spaced apart by a transverse plate member 64. The plate member 64 includes a plate portion 65 which engages strip end portion 51. At their respective distal ends 66, 67 the side framing member 62, 63 mount a rod 68, which in turn mounts a secondary torsion spring 69. The torsion spring 69 includes a first end 70 bringing pressure to bear on a tab 71 integral with distal end 67, and a second end 72 which brings pressure to bear on a lever arm 73, with a flat or continuous pinching edge 74. Pinching edge 74 and plate portion 65 cooperate to pinch or engage the strip end portion 51 therebetween. The clamping angle of lever arm 73 relative to plate portion 65 is selected so as to maximize the clamping force along edge 74. Therefore, as the linear force along the sandpaper strip increases, the clamping force provided along edge 74 also increases, thereby to assist the spring force of torsion spring 68 in tightly clamping against the sandpaper strip. Plate portion 65, distal end 66, 67 secondary torsion springs 69, and lever arm 73 may be referred to as a fastening means or clip and is similar in function to fastening means 30.

It should be noted that side framing member 62, 63 and lever arm 73 include holes for minimizing the weight of the connecting means 50. Base plate 52 also includes such weight-reducing holes (not shown). A counterweight is typically affixed to the inner surface of the cylindrical wall 20 diametrically opposite of the clip 30 to balance the drum 11.

In operation, the first strip end portion 31 is cut to form to a taper to lie flush with the outer edge of the cylindrical wall 20. Such a taper is shown in FIG. 4 as formed on the second strip end portion 51. The tapered first end portion 31 is then fed into edge slot 24 and is pinched between plate portion 38 and the lever arm edge 45 by operation of the lever arm 43. The abrasive strip 12 is then wound in a helical or spiral fashion from first drum end 22 to second drum 23. The strip 12 is wound such that the edges of the strip 12 lie flush with or adjacent to one another without overlapping. The second strip end portion 51 is then cut to a taper as shown in FIG. 4 to lie flush with the outer edge of the cylindrical wall 20. The tapered strip end portion 51 is then fed through edge slot 25 and pinched between plate portion 65 and the lever arm edge 74 by operation of the lever arm 73.

When the rotatable sanding drum 11 is rotated in a sanding operation, the rotation of the drum 11 against workpieces tends to cause the helical abrasive strip 12 to tighten its wrap about the drum 11, which in turn causes the strip 12 to stretch or linearly extend in the direction of drum end 23. As the strip 12 is linearly extended, the spring-biased fastener or connecting means 50 continually draws the strip end portion 51 inwardly generally toward the axis of the drum 11 by action of the main torsion spring 57 bringing pressure to bear on the tab 60 of the take-up lever arm 61 thereby taking up slack in the abrasive strip 12 and contributing to a more efficient sanding operation.

As shown in FIG. 5, reference letter A designates an initial position of the spring-biased fastener 50 before operation of the rotatable drum 11. Reference letter B in FIG. 5 represents a position of the spring-biased fastener 50 after a plurality of workpieces have been sanded. If the abrasive strip 12 is still in usable condition after the fastener 50 has been drawn to position B, the fastener 50 may be reset to position A by operation of lever arm 73 to release its grip of the strip end portion 51. The strip end portion 51 may also be recut at this time to form a taper of sufficiently narrow width to fit between side frame members 62, 63.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed is:

1. In combination with a rotatable sanding drum for sanding an object and being operated by a rotary drum sander, a fastener apparatus for securing abrasive paper to the rotatable sanding drum, the combination comprising:

a) a rotatable sanding drum for being operated on the rotary drum sander, the drum comprising first and second drum ends, each of said ends having a slot therein for passing a strip of abrasive paper therethrough;

b) a strip of abrasive paper for being wound on the rotatable drum from the first to second drum end, the strip comprising first and second strip end portions;

c) means connectable to the drum for fastening the first strip end portion to the first drum end, said means comprising a fixed plate member adjacent said slot, and a spring-biased lever arm having a pivotal clamping end and including a torsion spring biased toward said plate member, and means connectable to the drum for connecting the second strip end portion to the second drum end, the connecting means comprising a spring-biased take-up means for taking up slack in the strip of abrasive paper as the drum is operated, a plate member affixed to said take-up means, and a spring-biased lever arm having a pivotal clamping end and including a torsion spring biased toward said plate member.

2. The combination of claim 1, wherein each of the respective pivotal clamping ends includes a continuous edge for pinching the respective strip end portion against the plate member.

3. The combination of claim 1, wherein the take-up means includes a torsion spring.

4. The combination of claim 1, wherein each of said pivotal clamping ends respectively engage said plate member at an angle whereby tension on said strip of abrasive paper causes said clamping end to be urged more tightly against said plate member.

5. In combination with a rotatable sanding drum for sanding an object and being operated by a rotatable drum sander, a fastener apparatus for securing abrasive paper to the drum sander, the combination comprising:

a) a rotatable drum for being operated on the rotatable drum sander and having first and second ends and an axis, the drum ends having respective first and second slots, each of the slots extending in an axial direction of the drum;

b) a strip of abrasive paper for being wound in a helical fashion from one drum end to the other drum end, the strip having first and second end portions being fed through the respective first and second slots;

c) means connectable to the drum for fastening the first strip end portion to the first drum end, the fastening means comprising a plate member affixed adjacent said first slot, and a spring-biased lever arm having a pivotal clamping end, wherein said clamping end is biased against said plate member; and means connectable to the drum for connecting the second strip end portion to the second drum end, the connecting means including means for taking up slack in the strip of abrasive paper as the drum is operated, the connecting means comprising a spring-biased lever with proximal and distal ends, the proximal end being secured to the drum, the distal end comprising a plate member and a second spring-biased lever arm for pinching the second strip end portion against the plate member while the spring-biased lever continually draws the second strip end toward the axis of the drum to take up slack in the strip of abrasive paper as the rotatable drum is being operated.

6. The combination of claim 5, wherein each of said pivotal clamping ends respectively engage said palate member at an angle whereby extension on said strip of abrasive paper causes said clamping end to be urged more tightly against said plate member.

7. A clamping and biasing clip for securing an abrasive strip to a sanding drum and pulling the strip inwardly through a slot in the drum, comprising:

a) a base member having means for attachment to an inside surface of said drum adjacent said slot;

b) a pivotal arm attached to said base member at a first arm end, and having a second arm end pivotal over said slot;

c) spring biasing means for urging said second arm end inwardly and away from said slot; and d) clamping means for grasping said abrasive strip, mounted to said pivotal arm second end and positionable over said slot.

8. The apparatus of claim 7, wherein said clamping means further comprises a spring-biased lever pivotally mounted to said second end.

9. The apparatus of claim 8, further comprising a clamping surface mounted to said pivotal arm, proximally alignable with said slot, and wherein said spring-biased lever is urged against said surface.

10. The apparatus of claim 9, wherein said spiring-biased lever further comprises an L-shaped member having one end pivotally attached to said pivotal arm second end and having a corner segment pivotally urged against said clamping surface, and having a further end projecting inwardly away from said slot.

* * * * *

UNITED STATES PATENT AND TRADEMARK OFFICE

CERTIFICATE OF CORRECTION

PATENT NO. : 5,181,347

DATED : January 26, 1993

INVENTOR(S) : Gary L. Green

It is certified that error appears in the above-identified patent and that said Letters Patent is hereby corrected as shown below:

In column 3, line 47, "73" should be -- 43 --.

In claim 1, column 4, line 66, "means connectable" should be -- d) means connectable --.

In claim 5, column 5, line 39, "means connectable" should be -- d) means connectable --.

In claim 6, column 6, line 13, "extension" should be -- tension --.

Signed and Sealed this

Twenty-first Day of December, 1993

*Attest:*

Bruce Lehman

BRUCE LEHMAN

*Attesting Officer*

*Commissioner of Patents and Trademarks*